United States Patent [19]

Lichtinghagen

[11] 4,420,294

[45] Dec. 13, 1983

[54] APPARATUS FOR THE CONTINUOUS EXTRUSION OF ELECTRICALLY CONDUCTIVE GRANULATED MATERIALS, PREFERABLY POWDER METALLURGY MATERIALS

[75] Inventor: Klaus Lichtinghagen, Kirchhain, Fed. Rep. of Germany

[73] Assignee: Glacier GmbH-DEVA Werke, Stadtallendorf, Fed. Rep. of Germany

[21] Appl. No.: 323,537

[22] Filed: Nov. 20, 1981

Related U.S. Application Data

[62] Division of Ser. No. 115,082, Jan. 24, 1980, Pat. No. 4,380,473.

[30] Foreign Application Priority Data

Jan. 30, 1979 [DE] Fed. Rep. of Germany ..... 2903510

[51] Int. Cl.[3] ..... B22F 3/18

[52] U.S. Cl. ..... 425/79; 264/27

[58] Field of Search ..... 264/27; 425/79; 75/201, 75/214; 419/41, 52

[56] References Cited

U.S. PATENT DOCUMENTS

| | | | |
|---|---|---|---|
| 2,097,502 | 11/1937 | Southgate | 75/214 |
| 2,289,787 | 7/1942 | Kaschke | 75/214 |
| 2,708,770 | 5/1955 | Herres | 425/79 |
| 2,834,674 | 5/1958 | Silvasy et al. | 75/214 |
| 2,902,714 | 9/1959 | Johnson | 425/79 |
| 2,906,596 | 9/1959 | Ballhausen | 75/226 |
| 3,122,434 | 2/1964 | Reed et al. | 75/214 |
| 3,264,388 | 8/1966 | Roach | 264/125 |
| 3,284,372 | 11/1966 | Bailey | 264/27 |
| 3,340,052 | 9/1967 | Inoue | 75/201 |
| 3,656,946 | 4/1972 | Inque et al. | 75/226 |

*Primary Examiner*—Donald E. Czaja
*Assistant Examiner*—Mary A. Becker
*Attorney, Agent, or Firm*—Oblon, Fisher, Spivak, McClelland & Maier

[57] ABSTRACT

Apparatus for the continuous extrusion of electrically conductive granulated materials, preferably powder metallurgy materials, wherein the material is introduced into a duct of a die and is compressed and moved along the duct to and through a nozzle on the die by a punch movable in the duct, the material being sintered by heating it with electrical current passed therethrough via electrical connections made with the punch and nozzle.

11 Claims, 2 Drawing Figures

APPARATUS FOR THE CONTINUOUS EXTRUSION OF ELECTRICALLY CONDUCTIVE GRANULATED MATERIALS, PREFERABLY POWDER METALLURGY MATERIALS

This is a division of application Ser. No. 115,082, filed Jan. 24, 1980, U.S. Pat. No. 4,380,473.

BACKGROUND OF THE INVENTION

1. Field of the Invention

This invention relates to a process for the continuous extrusion of electrically conductive granulated materials, preferably powder metallurgy materials, in which the material is introduced into a die and is compressed by the moving strokes of a punch in a die passage duct, against a frictional resistance which is built up by a section of the material strand already compressed therein, is advanced by the pressure of the compression stroke in the duct, is sintered on heating by electrical currents, and is extruded through a nozzle.

2. Description of the Prior Art

It is known (DE-AS No. 27 33 009) to continuously extrude powder metallurgy materials in a die and to heat the material by induction being provided within a certain zone in which the sintering of the compressed material takes place. The inductive eddy currents produced in these circumstances for heating the already compressed strand of material mainly result in heating of the metal dies used and are produced only to a minor degree on the surface of the conductive strand itself. The complete strand heating required for sintering thus takes place substantially solely by thermal conduction from the die or the outer surface of the strand to the interior thereof. Certain difficulties may occur in these circumstances so that the inner cross-sections of the strand are not always reliably reached or else relatively very different temperature zones occur, at least locally, within the strand of material. The effect of the induction heating is also restricted to the place where the electromagnetic field of the inductive heating installation acts on the strand. Furthermore, the relatively expensive induction heating system require a fairly large amount of space. In addition, inductive heating systems cannot be used for all electrically conductive materials, but only for those which are magnetizable.

SUMMARY OF THE INVENTION

In view of the foregoing, the object of the invention is to improve a process of the kind indicated above so as to allow heating of all electrically conductive materials, enable the strand of material in the die to be heated more uniformly throughout all its cross-sections than with inductive heating, and also to provide heating which increases as the degree of compression of the material decreases, while at the same time the equipment required is kept very small.

According to the invention, a process of the kind referred to hereinabove is characterized in that sintering is effected by means of a current directed in the longitudinal direction of the strand to heat all the material situated in the duct between the punch and the nozzle. The steps according to the invention thus produce a directional flow of current within the strand of material in the die, instead of the known inductive eddy currents, and this current flows in the longitudinal direction of the strand throughout all the conductive cross-sections so that even internal cross-sections are heated without difficulty. In this way, it is possible to obtain very uniform heating through all the conductive cross-sections with any electrically conductive material.

The invention makes use of the knowledge that electrically conductive materials, e.g. metals, metalloids or second-class conductors (e.g. graphite), have a clearly increasing electrical resistance with decreasing density. This is due to the fact that as the density decreases the contact areas of adjacent particles decrease and hence the flowing current increasingly encounters greater resistance. The resulting losses are practically all converted to thermal energy. In light of this fact, the process according to the invention utilizes the possiblity of compressing the powder metallurgy products under pressure with the simultaneous action of temperature so that maximum strengths can be obtained for the extruded strand. Since there is a limit to these strength properties, as a result of the properties of the materials from which the tools are made, it is desirable to apply a high mechanical pressure at the same time for the production of sintered components (e.g. on an iron base) at the sintering temperatures of about 1150° C. used. This results in parts of maximum strength and optimum density, this goal hitherto being unattainable because of the tool problem, since on the one hand even high-temperature strengh steels do not have inherent strength at such temperatures while on the other hand the ceramic materials that can be used, e.g. silicon nitride or aluminium oxide, are no longer able to take even minor tensile stresses at such temperatures, even though they have appropriate resistance and inherent strength. Since such tensile stresses are inevitable inside a die when a material is extruded, the simultaneous application of high pressures at such sintering temperatures was hitherto impossible. The process according to the invention provides a possibility which results in hitherto unknown good properties of the extruded material.

With induction heating systems, the heating of electrically conductive materials was also limited by the fact that the support materials possibly used for the ceramic matrix inside the die bore were also inductively energized and/or no longer had sufficient strength for the pressing operation at high temperatures, e.g. above 1000° C. External resistance heating was also impossible hitherto for the same reasons.

The process according to the invention enables the increasing internal resistance of electrically conductive materials with decreasing density to be utilized for their internal heating by making use of the high thermal compressive strength of ceramics and their electrical insulation properties. In these conditions, the temperature decreases sharply inside the compressed strand, from the punch towards the nozzle, because the maximum compression has already occurred in the region of the nozzle where there is at the same time excellent contact. On the other hand, during the pressing operation, the high internal resistance of the added material for compression at the top end of the strand produces very intensive and precise internal heating of this material so that sintering under pressure is possible and results in the remarkable strength properties of the resulting extrusion.

A very simple facility for producing the required directional flow of current within the strand of material in the die is preferably to produce the current flow in the material by applying a voltage between the nozzle and the punch. This results in very small requirements in respect of equipment, and as the punch moves up and down the current flow can simultaneously be automatically initiated and discontinued at the start and end of the compression stroke.

Preferably, in a process according to the invention, the current flow is not initiated simultaneously with the first contact of the punch and the material for compression at the top of the die; instead, it is postponed until the punch has already covered about half its compression stroke in each case. This prevents any burning of the powder on the contacts (the punch and nozzle), e.g. due to flashover. Where the top punch is used as a co-acting contact, it is advisable not to switch on the electrical current until the material for compression has reached about 50% of the attainable density.

In another advantageous aspect of the process according to the invention, the current flow is interrupted either at the end of each compression stroke or, and sometimes this is particularly preferable, it is not interrupted until an adjustable interval after the end of the compression stroke. Consequently, current continues to flow for a certain period in the already compressed material, even after the end of the compression stroke, so that corresponding heating takes place.

The voltage preferably used for the heating current in the process according to the invention is from 2 to 5 V, and this can be stepped down from the conventional main voltage without difficulty with a simultaneous increase of the current.

To enable the process according to the invention to be particularly adapted to the specific requirements of each individual case, it is advantageous if the current flow is not switched on until after the start of the compression stroke and is not switched off until after the end thereof. Advantageously, the duration of the interval between switching on of the current flow and the start of the compression stroke and/or the switching off of the current flow and the end of the compression stroke is adjustable. In some cases it is very advantageous if the time at which the current flow is switched on is adjusted in dependence on a representative value for the degree of compression of the material beneath the punch, i.e. the material between the punch and the top end of the already compacted strand.

In another advantageous possibility of adapting the process according to the invention to the specific conditions of each individual case, the speed of the punch or the intensity of the current flow through the material is varied in a controlled manner during the compression stroke. Preferably, the current flow is increased as the punch travel increases.

With the process according to the invention it is possible to manufacture electrically conductive materials, whose sintering temperatures are far above the temperatures hitherto attainable. For example, even ferrous materials, the sintering temperatures of which are in the region of about 1150° C., can be produced from powder metallurgy materials by a continuous extrusion process using the process according to the invention.

The invention also relates to apparatus for performing a process according to the invention. Starting with apparatus of the kind defined hereinbefore, the apparatus according to the invention is characterized in that for the purposes of heating the material in the die, the punch and the nozzle are connected to the terminals of a power supply and the wall of the duct consists of an electrically non-conductive material. Preferably, a switching means is provided whereby the voltage is not applied to the punch and to the nozzle until after the starting of the compression stroke. Advantageously, the material of the wall of the die duet consists of a ceramic material, preferably silicon nitride or aluminium oxide. These preferred aspects of the apparatus according to the invention provide a very simple construction thereof and also result in apparatus which allows the process according to the invention to be performed with minimum expense.

For the production of hollow strands, the apparatus according to the invention preferably comprises a punch consisting of a central mandrel and a top punch disposed around the same and movable relative thereto for compressing the material in the die, and the top punch consists of electrically conductive material and is connected to one terminal of a power supply, while the central mandrel has a wall of electrically non-conductive material along that zone which comes into contact with the string of material in the duct. This results in electrical insulation of the central mandrel with high inherent strength even at high temperature. The rest of the central mandrel preferably consists of steel, and to maintain the inherent stength of the central mandrel this steel core may have additional cooling substantially radially inside the ceramic bush. The top punch then represents the co-acting contact required for the current flow.

Preferably, the top punch is fixed on an intermediate plate which bears, through the insulated interposition of a resilient member, against a head plate connected to the central mandrel. Advantageously, the resilient member comprises cup springs which are disposed between the head plate and the intermediate plate and the surfaces of which are in contact with the intermediate plate consist of thin-walled electrically non-conductive bushes. It is significant that in these conditions electrical insulation is always maintained between the head plate and the intermediate plate. As a result of the resiliency, the head plate and intermediate plate are held at a specific travel distance in the expanded state, the spring force preferably being such that the required pressing force for the annular cross-section is obtained after about 30% of the travel and can then rise to a maximum of 1.5 times the calculated compression pressure.

In another advantageous aspect of the apparatus according to the invention, the non-conductive wall of the central mandrel is shorter than the length of the zone of contact between the central mandrel and the material, and the central mandrel is adapted to be connected to the corresponding terminal of the power supply after the current flowing through the top punch has been switched off. In the production of such tubular cross-sections it is possible for the central mandrel and the top punch to be kept alternately live. The central mandrel can be connected as a live pole after the current has been switched off in the top punch, by making the ceramic bush in the die correspondingly shorter. This gives the advantage that a current continues to flow with corresponding heating taking place in the material which has already been compressed. At the same time, the amplitude of the generally sinusoidal temperature gradient is somewhat decreased during the pressing operation.

Advantageously, according to the invention, guides are provided for the relative movement between the head plate and the intermediate plate. These guides may preferably consist of hardened steel studs fixed on the head plate and extending through thin-walled bushes provided in the intermediate plate. Here again, the important point is that the electrical insulation is always maintained between the head plate and the intermediate plate despite the guides and the interposed resilient member.

In another preferred embodiment of the apparatus according to the invention, an electrically conductive ring is embedded in the electrically non-conductive matrix, at mid-height therein, and its inner surface is flush with the inner surface of the duct. Instead of the top punch, the ring and the nozzle are connected to the terminals of a power supply, a permanent current flow being possible between the already compressed metal particles of the material strand in the die, independently of the movement of the top punch. If required, specific heating conditions may be obtained in the compressed metal powder by a suitable choice of the vertical position of this ring inside the matrix.

BRIEF DESCRIPTION OF THE DRAWINGS

Various other objects, features and attendant advantages of the present invention will be more fully appreciated as the same becomes better understood from the detailed description when considered in connection with the accompanying drawings wherein like reference characters designate like or corresponding parts throughout the several views, and wherein.

DETAILED DESCRIPTION OF THE PREFERRED EMBODIMENTS

Figure 1:
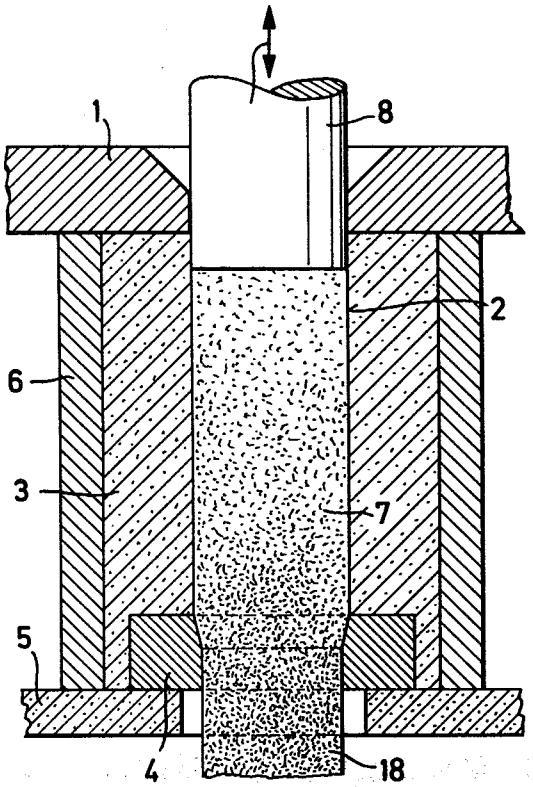
FIG. 1 is a basic cross-section through a device according to the invention for the production of a continuous solid strand.

Referring to FIG. 1, the device comprises a filler plate 1 disposed above a die containing a passage duct 2. This duct is surrounded by a wall 3 (matrix) consisting of an electrically non-conductive and preferably ceramic material, which is held and supported radially from outside by a supporting wall 6. A nozzle 4 is inserted at the bottom end of the opening of the duct 2 and has a calibration orifice which tapers radially inwards to some extent. A ring 5 is used to take the forces acting on the nozzle 4 during the extrusion process.

A punch 8 is also provided which serves to compact or compress the material 7 in the duct 2 from above. The punch 8 and the nozzle 4 are connected (not shown in FIG. 2) to the terminals of a power supply (not shown). To produce a solid material, the punch is used as a co-acting contact, the electrical current not being switched on until the material for compression has reached about 50% of the possible density. As soon as the punch 8 has performed its full compression stroke, it is withdrawn upwardly again, so that the current flowing in the material 7 situated above the passage 2 is broken, new granulate is introduced into the die from above via the filler plate, and then the punch 8 is moved down again to perform a new compression stroke. In this way it is possible to produce a continuous strand, with sintering taking place at high temperatures and under high pressure. As a result of the current flow from the nozzle 4 to the punch 8 and the resulting heating of the entire section of the strand situated inside the die, sections of the strand which have already been compressed and sintered can undergo re-sintering until they reach the nozzle 4.

Figure 2:
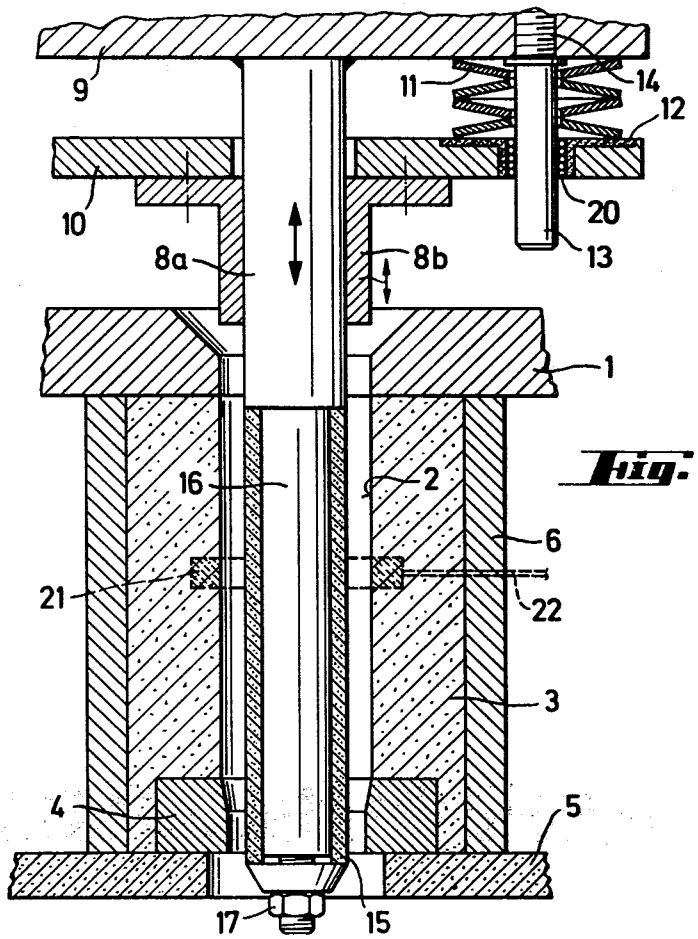
FIG. 2 is a similar view showing a device according to the invention for the production of a hollow stand.

FIG. 2 shows a device for the continuous production of tubular members. A filter plate 1 is again provided, followed by a die having a passage duct 2 which is again surrounded by an electrically non-conductive matrix 3 which bears radially outwards against a supporting wall 6. As in the device shown in FIG. 1, the bottom end of the matrix 3 is provided with a nozzle 4 of electrically conductive material connected to one terminal of a power supply (not shown). A ring 5 supports the nozzle 4 in the outward direction axially.

The single punch 8 used in FIG. 1 is in this case replaced by a punch system consisting of a central mandrel 8*a* and a top punch 8*b* which radially surrounds the mandrel 8*a* and is displaceable relatively thereto. The top punch 8*b* is fixed on an intermediate plate 10, while the central mandrel 8*a* extends upwardly through the intermediate plate 10 and is fixed at the top to a head plate 9, on which hardened steel guide studs 13 are screwed by means of screw threads 14. These guide studs 13 are used to guide the intermediate plate on a relative movement with respect to the head plate, cup springs 11 also being provided around the studs 13 to keep the head plate 9 and the intermediate plate 10 a specific distance apart. The spring force is so designed that after some 30% of the travel possible between the intermediate plate 10 and the head plate 9 the pressing force required for the annular cross-section is obtained and can rise to a maximum of 1.5 times the calculated compression pressure when fully pressed into the maximum travel. The steel studs 13 used as guides (FIG. 2 shows only one of these as an example) extend into ball-bearing bushes 20 for accurate guidance, these bushes being embedded in the intermediate plate 10. The electrical separation of the head plate 9 and the intermediate plate 10 is obtained by the provision of an electrically nonconductive thin-walled bush 12 between each guide bush 20 and the intermediate plate 10. On a relative movement of the head plate 9 to the intermediate plate 10, each guide stud 13 can slide in the ball-bearing bushes 20 so that accurate guidance of the two plates is ensured.

The central mandrel 8*a* consists of steel, but is surrounded by a ceramic bush 15 inside the sintering and compression zone of the material to the die. This ensures electrical insulation together with high inherent strength at temperature. The steel core 16 inside the ceramic bush 15 may be provided with additional cooling in order to maintain its inherent strength, and any conventional cooling system is suitable for this purpose. The top punch 8*b* serves as the co-acting contact for the current flow in this system and is fixed on the movable intermediate plate and can be connected to one terminal of a power supply.

The apparatus shown in FIG. 2 operates as follows (similar remarks apply to the operation of the device shown in FIG. 1):

An annular member corresponding to the outlet cross-section between the nozzle 4 and the central mandrel 8*a* is first introduced loosely into the die system whereupon granulated material is fed via the filler plate 1 and is intermittently compressed until a ring originally introduced therein is ejected as a "dead head". The nozzle 4 and the top punch 8*b* are respectively connected to the two terminals of a power supply, whereupon the following process takes place:

In the material which is initially cold-compressed and which has relatively low internal resistance, the current flows from the nozzle 4 to the top part of the material strand in the die, where there is only a small accumulation of powder. The downward stroke results in the release of the central mandrel, the end of which is conical and which is closed by a nut 17 and which is first moved downwards, whereupon the material is compressed via the top punch 8*b*, while the top punch conducts the current at the same time. During this compression operation the originally high electrical resistance in the slowly compressed powder is decreased and, the current simultaneously correspondingly converted to heat. A temperature gradient can be demonstrated, because the compression of the extruded tube increases towards the nozzle 4. While the top punch 8*b* together with the central mandrel 8*a* now performs a parallel movement for further compression of the material and for pushing the strand of material in the die 2, post-compression from outside takes place via the nozzle 4.

In these conditions, the pressure of the springs 11 builds up at the same time until the total required travel has been reached. On the following expansion, the pressure of the springs 11 initially decreases, thus ensuring that the tube can be calibrated in the die from the inside. At the same time, however, the pressure of the top punch 8*b* still rests on the strand. If the two punches are slowly moved down again, the central mandrel 8*a* alone moves solely over the last section of the movement before complete relaxation of the springs 11, while the top punch 8*b* no longer has any contact with the extruded strand. Refilling starts then.

This ensures that the strand is reliably prevented from tearing apart during the different relative movements of the top punch 8*b* and the central mandrel 8*a*.

In this process, the conventional main voltage of 220 V is stepped down to a value of between 2 and 5 V with a simultaneous high current flow (welding transformer principle). After about 50% of the compressison travel, the current flow is permitted, thus avoiding any burning of the powder on the contacts due to flashover. Alternatively, the central mandrel 8*a* and the top punch 8*b* may be kept alternately live, but this requires appropriate shortening of the central mandrel ceramic bush so that the central mandrel 8*a* can be connected as a live terminal after the top punch 8*b* has been switched off. The effect of this is that current continues to flow in the already compressed material and corresponding heating takes place. Since even graphite, being a second-class conductor, is subject to the indicated physical laws concerning the relationship of the internal resistance to the degree of compression, it is quite possible to make even graphite tubes by the indicated process.

In another embodiment of the apparatus according to the invention, a ring 21 embedded in the matrix is used instead of a live top punch 8 or 8*b*, as shown in broken lines in FIG. 2. Ring 21 is then connected via a connection facility 22 to the terminals of a power supply together with the nozzle 4. This enables a continuous flow of current to be produced in that section of the strand of material in the die 2 which is situated between the ring 22 and the nozzle 4. Ring 21 is preferably disposed substantially at mid-height of the matrix 3 so that even when the top punch 8*b* or 8 is moving out of the die a continuous flow of current is maintained within the section of the strand of material still left in the die, i.e., the vertical position of the ring 21 inside the matrix 3 should be so selected that there is always conductive contact with the part of the strand of material left in the die 3, even when the top punch 8*b* is extended.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. An apparatus for performing a process for the continuous extrusion of electrical conductive granulated material, preferably powder metallurgy material, comprising:

a die having a wall defining a passage duct for the travel of said material and wherein said wall comprises an electrically non-conductive material;

a nozzle disposed on said die;

a reciprocating punch movable into said duct for compressing and advancing said material in said duct and for extruding a string of said material through said nozzle on said die;

a power supply having electrical terminals; and means for connecting said punch and said nozzle to said terminals of said power supply, whereby said material in said duct is heated by a longitudinal flow of electric current therethrough as said material is being compressed and advanced.

2. An apparatus according to claim 1, further comprising switching means for applying said electrical currents to said punch and to said nozzle only after the start of said compressing.

3. An apparatus according to claim 1 or 2, wherein said material of said wall of said die duct further comprises a ceramic material, preferably silicon nitride or aluminum oxide.

4. An apparatus according to claims 1 or 2, wherein said punch further comprises a central mandrel having an outer surface portion for contacting said string of said material and a top punch disposed around said mandrel and movable relative thereto for comprising said material in said die, wherein said top punch comprises electrically conductive material, means for connecting said top punch to one of said terminals of said power supply, and wherein said central mandrel comprises a wall of electrically non-conductive material disposed along said portion of said mandrel which contacts said string of said material disposed in said duct.

5. An apparatus according to claim 4, wherein said material of said wall of said die duct further comprises a ceramic material, preferably silicon nitride or aluminum oxide.

6. An apparatus according to claim 4 further comprising a headplate connected to said central mandrel, an intermediate plate connected to said top punch, and an electrically insulated resilient member disposed between and contacting said intermediate plate and said headplate.

7. An apparatus according to claim 6 wherein said resilient member further comprises cup springs disposed between said headplate and said intermediate plate, and thin-walled electrically non-conductive bushes disposed within said intermediate plate and contacting at least one of said cup springs for electrically insulating said intermediate plate from said cup springs and said headplate.

8. An apparatus according to claim 7, wherein said non-conductive wall of said central mandrel is shorter than the length of said outer surface of said central mandrel for contacting said string of said material, and wherein said central mandrel further comprises means for connecting said central mandrel to one of said terminals of said power supply after said electrical currents flowing through said top punch have been switched off.

9. An apparatus according to claim 8, further comprising guide means operatively associated with said headplate for guiding the relative movement between said headplate and said intermediate plate.

10. An apparatus according to claim 9, wherein said guide means further comprises steel studs fixed on said headplate and extending through said thin-walled bushes within said intermediate plate.

11. An apparatus for performing a process for the continuous extrusion of electrically conductive granulated material, preferably powder metallurgy material, comprising:

a die having a wall defining a passage duct for the travel of said material;

a nozzle disposed on said die;

a power supply having electrical terminals;

a reciprocating punch movable into said duct for compressing and advancing said material in said duct and for extruding a string of said material through said nozzle disposed on said die; and means for heating said material in said duct with electrical currents, wherein said wall of said die passage duct comprises an electrically non-conductive material, an electrically conductive ring embedded within a central portion of said wall such that the inner annular surface of said ring is flush with the inner surface of said duct, and wherein said ring and said nozzle are connected to said terminals of said power supply whereby said material in such duct is heated by a longitudinal flow of electric current therethrough as said material is being compressed and advanced.

* * * * *